US010011382B2

(12) United States Patent
Schilling

(10) Patent No.: US 10,011,382 B2
(45) Date of Patent: Jul. 3, 2018

(54) SHRINK TUNNEL SYSTEM AND ASSOCIATED METHOD FOR SHRINKING A SHRINK FILM ONTO PACKAGE FORMATIONS

(71) Applicant: KHS GmbH, Dortmund (DE)

(72) Inventor: Christian Schilling, Diemelsee (DE)

(73) Assignee: KHS GmbH, Dortmund (DE)

( * ) Notice: Subject to any disclaimer, the term of this patent is extended or adjusted under 35 U.S.C. 154(b) by 499 days.

(21) Appl. No.: 14/769,861

(22) PCT Filed: Aug. 16, 2013

(86) PCT No.: PCT/EP2013/002472

§ 371 (c)(1),
(2) Date: Aug. 24, 2015

(87) PCT Pub. No.: WO2014/127790

PCT Pub. Date: Aug. 28, 2014

(65) Prior Publication Data

US 2016/0001908 A1 Jan. 7, 2016

(30) Foreign Application Priority Data

Feb. 22, 2013 (DE) ..... 10 2013 101 782

(51) Int. Cl.

| | |
|---|---|
| ***B65B 53/02*** | (2006.01) |
| ***B65B 53/06*** | (2006.01) |
| ***B65B 21/24*** | (2006.01) |
| ***B65B 35/44*** | (2006.01) |

(52) U.S. Cl.

CPC ..... *B65B 53/063* (2013.01); *B65B 21/245* (2013.01); *B65B 35/44* (2013.01)

(58) Field of Classification Search

CPC ..... B65B 53/06; B65B 53/063; B65B 53/02
USPC ..... 53/441, 442, 556
See application file for complete search history.

(56) References Cited

U.S. PATENT DOCUMENTS

| | | | | |
|---|---|---|---|---|
| 3,357,153 | A | 12/1967 | Shaffer | |
| 3,668,817 | A * | 6/1972 | Bell | B65B 53/063 219/388 |
| 3,727,324 | A * | 4/1973 | Melgaard | B65B 53/063 34/216 |
| 3,744,146 | A * | 7/1973 | Nichols | B65B 53/063 34/212 |
| 3,897,671 | A | 8/1975 | Higgins | |
| 4,059,400 | A * | 11/1977 | Heckman | B29C 63/423 432/124 |
| 4,579,614 | A * | 4/1986 | Burmeister | F26B 3/283 156/499 |

(Continued)

FOREIGN PATENT DOCUMENTS

| | | |
|---|---|---|
| DE | 15 11 562 | 8/1969 |
| DE | 19 44 047 | 3/1970 |

(Continued)

*Primary Examiner* — Gloria R Weeks
(74) *Attorney, Agent, or Firm* — Occhiuti & Rohlicek LLP

(57) ABSTRACT

An apparatus for shrinking a shrink film onto a package formation includes a shrink tunnel-system having gas conductors that direct hot gas into the tunnel's interior along first and second flow-directions that are opposite to each other and parallel to a direction in which the package formation is conveyed through the shrink tunnel.

22 Claims, 4 Drawing Sheets

(56) References Cited

U.S. PATENT DOCUMENTS

| | | | | | |
|---|---|---|---|---|---|
| 4,979,314 | A * | 12/1990 | Fresnel | B65B 53/063 | 34/104 |
| 5,400,570 | A * | 3/1995 | Bennett | B65B 53/04 | 34/216 |
| 6,151,781 | A * | 11/2000 | Dehler | A24F 13/26 | 131/248 |
| 6,546,645 | B2 * | 4/2003 | Chung | B65B 53/066 | 239/567 |
| 6,648,634 | B2 * | 11/2003 | Nava | B65B 53/063 | 432/121 |
| 6,689,180 | B1 * | 2/2004 | Liao | B65B 53/063 | 34/211 |
| 7,823,366 | B2 * | 11/2010 | Schoeneck | B23K 26/0648 | 156/272.8 |
| 8,051,629 | B2 * | 11/2011 | Pazdernik | B65B 61/12 | 219/388 |
| 8,235,712 | B1 * | 8/2012 | Lewis | B65B 53/02 | 432/121 |
| 9,027,313 | B2 * | 5/2015 | Copp | B65B 53/063 | 53/442 |
| 9,032,696 | B2 * | 5/2015 | Schilling | B65B 53/06 | 53/442 |
| 9,517,853 | B2 * | 12/2016 | Koolhaas | B29C 63/423 | |
| 2004/0123566 | A1 * | 7/2004 | Limousin | B65B 53/063 | 53/442 |
| 2008/0045136 | A1 | 2/2008 | Huang | | |
| 2014/0020344 | A1 * | 1/2014 | Liao | B65B 53/063 | 53/557 |
| 2014/0041341 | A1 * | 2/2014 | Koolhaas | B29C 63/423 | 53/442 |
| 2017/0174378 | A1 * | 6/2017 | Gatteschi | B65B 21/245 | |

FOREIGN PATENT DOCUMENTS

| | | |
|---|---|---|
| DE | 66 09 723 | 9/1972 |
| DE | 39 24 871 | 2/1991 |
| DE | 10 2007 030 264 | 1/2009 |
| EP | 0 538 925 | 4/1993 |
| EP | 2 319 769 | 5/2011 |
| EP | 2 554 483 | 2/2013 |
| GB | 1 200 898 | 8/1970 |
| JP | 46-2556 | 1/1971 |
| JP | S5050186 | 5/1975 |
| JP | 2007/137502 | 6/2007 |
| WO | WO2008/021243 | 2/2008 |

* cited by examiner

SHRINK TUNNEL SYSTEM AND ASSOCIATED METHOD FOR SHRINKING A SHRINK FILM ONTO PACKAGE FORMATIONS

RELATED APPLICATIONS

This application is the national stage under 35 USC 371 of PCT/EP2013/002472, filed on Aug. 16, 2013, which claims the benefit of the Feb. 22, 2013 priority date of German application 10 2013 101 782.7, the contents of which are herein incorporated by reference.

FIELD OF INVENTION

The invention relates to shrink-wrapping, and in particular, to a shrink-tunnel system with an improved flow behavior and an associated method for shrinking a shrink film onto package formations.

BACKGROUND

Shrink tunnel-systems for shrinking a shrink film onto package formations are well known.

The process of shrinking the shrink film includes loosely wrapping a package formation in shrink film and applying a flow of hot air to it. The flow is oriented onto the side of the package formation to seal the ends of the shrink film overlapping at that point so that they are welded or otherwise bonded to each other.

In known shrink-wrap methods undesired edge folding occurs. This results in messy shrink-wrapping with wrinkles that detract from the appearance of the finished product.

SUMMARY

A disadvantage of known shrink-tunnel systems is that flow arrives at the package formation in an uncontrolled manner. As a result, the level of effectiveness of the shrink-on process depends on the form of the package formation. Sometimes, undesired edge folding of the shrink film can occur as a result.

The invention provides a shrink-tunnel system and an associated method that improves the effectiveness of known shrink-wrapping methods and that also reduces energy consumption.

In one aspect, the invention features an apparatus for shrinking a shrink film onto a package formation. Such an apparatus includes a shrink tunnel-system that has a tunnel housing, a conveyor, and air conductors. The tunnel housing encloses a tunnel interior through which the conveyor moves a package formation wrapped with shrink film along a conveying direction. The air conductors direct hot air into the tunnel interior along a first flow-direction that is parallel to the conveying direction and also in a second flow-direction that is opposite the first flow-direction.

In some embodiments, some of the air conductors direct hot air into the tunnel interior in the first flow-direction while others direct it in the second flow-direction.

In yet other embodiments, an average flow within the tunnel housing is equal to zero during operation, wherein the average flow is a volume integral of a flow field within the tunnel interior.

In other embodiments, the tunnel interior has an inlet zone and an outlet zone that adjoins the inlet zone. In these embodiments, air conductors in a first set of air conductors are disposed in the inlet zone and air conductors in a second set of air conductors are disposed in the outlet zone. The air conductors in the first set introduce the flow in the first flow-direction, and air conductors in the second set introduce the flow in the second flow-direction.

In yet other embodiments, the air conductors are configured to cause flow to rise constantly along the conveying direction.

Alternative embodiments include lateral tunnel-walls. These include embodiments in which air conductors are arranged on those walls, embodiments in which the tunnel-walls at least in part form the air conductors, and those in which the air conductors are integrated into the lateral tunnel-walls.

In additional embodiments, the air conductors are configured to cause the flow to be distributed evenly along a height of the tunnel interior.

Yet other embodiments have a lateral tunnel-wall that at least in part defines the tunnel interior. In these embodiments, the air conductors comprise a set of openings in the lateral tunnel-wall. In some of these embodiments, a first opening from the set directs hot air along the first flow-direction, and a second opening from the set directs hot air along the second flow-direction. Also among these embodiments are those in which an area that protrudes into the tunnel interior surrounds each opening. In some embodiments, the protruding area has a structural feature that indicates that it has been embossed. Such features may include particular patterns of deformation and stress associated with the use of an embossing tool that would not be present if, for example, the area had been cast. Other embodiments include a set of nozzles in the lateral tunnel-wall, with each nozzle being formed by an opening and a protruding area surrounding that opening.

In other embodiments, an opening in a lateral tunnel-wall includes a structural feature that indicates that it was made by a laser. Such a feature may include, for example, the presence of re-solidified metal showing flow marks indicative of having been cut by laser.

In other embodiments, the tunnel housing defines an axis, the openings in the set of openings have diameters, each opening has a position along the axis, diameters of the openings vary as a function of a position of the opening on the axis, and the diameters increase monotonically with position. In other words, as one proceeds down the tunnel, the openings become progressively larger.

Although the openings are often circular, in some embodiments, the openings include slots. These slots are adjacent to the conveyor.

Yet other embodiments feature a lateral tunnel-wall that at least in part defines the tunnel interior, and that includes a metal panel. In these embodiments, the air conductors are openings formed in the metal panel. In some of these embodiments, there is a structural feature indicative first opening having been made by a metal punch. For example, the edges of the opening may be slightly deformed to indicate the occurrence of a force exerted by the punch.

In another aspect, the invention features a method for shrinking a shrink film onto a package formation. Such a method includes moving a package formation that has been loosely wrapped with shrink film through a tunnel interior along a conveying direction, and, while the package formation is in the tunnel interior, exposing the package formation to flow of hot gas, such as hot air, that is directed along a first direction and to flow that is directed along a second direction that is opposite to the first direction, wherein the first direction is parallel to the conveying direction.

In some practices, exposing the package formation to flow that is directed along a first direction and to flow that is directed along a second direction that is opposite to the first direction comprises passing the package formation through an inlet zone, at the inlet zone, exposing the package formation to the flow that is directed along the first direction, passing the package formation through an outlet zone, and, at the outlet zone, exposing the package formation to the hot-air flow that is directed along the second direction, In other practices, exposing the package formation to hot-air flow that is directed along a first direction comprises causing hot air to enter the tunnel interior through air conductors provided on lateral walls that at least in part define the tunnel interior.

In yet another aspect, the invention features a shrink tunnel-system having air conductors that direct hot air into the tunnel's interior along first and second flow-directions that are opposite to each other and parallel to a direction in which the package formation is conveyed through the shrink tunnel.

A significant aspect of the shrink-tunnel system according to the invention arises from having air conductors that introduce hot air-flow into the tunnel's interior with a first flow-direction oriented along the conveying direction and a second flow-direction oriented against the conveying direction. The targeted feed of the hot-air flow into the tunnel interior and thus onto the package formations wrapped with the shrink film tends to avoid the formation of defective shrink points. This results in a clear improvement in the quality of the shrink process. This is particularly advantageous with printed films, where the overall printed design depends on proper wrapping. There also arises a perceptible reduction in energy consumption.

Because the air conductors are to direct the hot-air flow in first and second flow-directions, it is practical to generate the hot-air flow centrally and to introduce it into the tunnel interior by the air conductors with a specified flow-direction.

The shrink tunnel's interior is preferably divided into an inlet zone and an adjoining outlet zone. First air conductors in the inlet zone introduce the hot-air flow with a first flow-direction, and second air-conductors in the outlet zone introduce the hot-air flow with a second flow-direction. In the inlet zone, a rear free-end of the shrink film is laid on the package formation and a front free-end of the shrink film is lifted off the package formation. Conversely, in the outlet zone, the front free-end of the shrink film is laid on the package formation and the rear free-end of the shrink film is lifted off the package formation. Due to this directed application of the shrink film with the hot-air flow, a considerable improvement in the shrink result arises.

The air conductors are advantageously designed in such a way that the hot-air flow introduced into the tunnel interior rises constantly in the conveying direction. The air conductors are advantageously designed to generate a hot-air flow that is distributed evenly over the height of the tunnel interior. These measures improve the quality of the shrinking process.

In some embodiments, two lateral tunnel-walls bound the tunnel's interior. The air conductors are arranged along the lateral tunnel-walls. Among these embodiments are those in which the air conductors are at least partially formed by the lateral tunnel-walls themselves, as well as those in which the air conductors are integrated into the lateral tunnel-walls.

In some embodiments, the lateral tunnel-walls are made of metal panels that have a multiplicity of openings to introduce the hot-air flow into the tunnel interior. These form the air conductors. In these embodiments, the openings are formed so as to impose a first or second flow-direction on the hot air emerging through the openings. The area of the lateral walls around the openings has a bowed contour that bows outward into the tunnel's interior. This results in a nozzle structure formed by the openings and the areas of the lateral tunnel-walls around them.

Preferably, a metal punch or laser makes the openings and an embossing tool makes the bowed contour of the area around the openings.

In some embodiments, the diameter of the openings increases along the tunnel interior. Due to the described design of the lateral tunnel-walls according to the invention, the air conductors are simple and inexpensive to manufacture.

In another embodiment, openings next to the conveyor are shaped like slots. This provides superior lifting of the shrink film's free ends and thus leads to a better shrink result.

In another aspect, the invention features a method for shrinking a shrink film onto a package formation in a shrink-tunnel system comprising a tunnel interior, in which the package formations that have been loosely wrapped with shrink film are moved in a conveying direction through the tunnel's interior by at least one conveyor and exposed to a flow of hot-air within the tunnel's interior. A significant aspect of the method lies in the fact that at least one hot-air flow is applied to the package formations wrapped with the shrink film, said air-flow having a first flow-direction oriented along the conveying direction and a second flow-direction oriented against the conveying direction.

A particularly advantageous practice includes moving the package formation through an inlet zone of the tunnel's interior and through an outlet zone next to the inlet zone. In the inlet zone, the hot-air flows with a first flow-direction. In the outlet zone, the hot-air flows with a second flow-direction. Air conductors along the tunnel's lateral walls direct the hot air in the first and second flow-directions.

As used herein, the expressions "substantially," "approximately," and "around" mean deviations from an exact value in each case by ±10%, preferably by ±5% and/or deviations in the form of changes that are not significant for function.

Although the specification refers specifically to air as a medium of heat transfer within the shrink tunnel, it is to be understood that any gas or gas mixture can be used. The claims are thus in no way limited to air.

Further developments, benefits and application possibilities of the invention arise also from the following description of examples of embodiments and from the figures. Moreover, all characteristics described and/or illustrated individually or in any combination are categorically the subject of the invention, regardless of their inclusion in the claims or reference to them. The content of the claims is also an integral part of the description.

BRIEF DESCRIPTION OF THE FIGURES

These and other features of the invention will be apparent from the following detailed description and the accompanying figures, in which.

DETAILED DESCRIPTION

Figure 1:
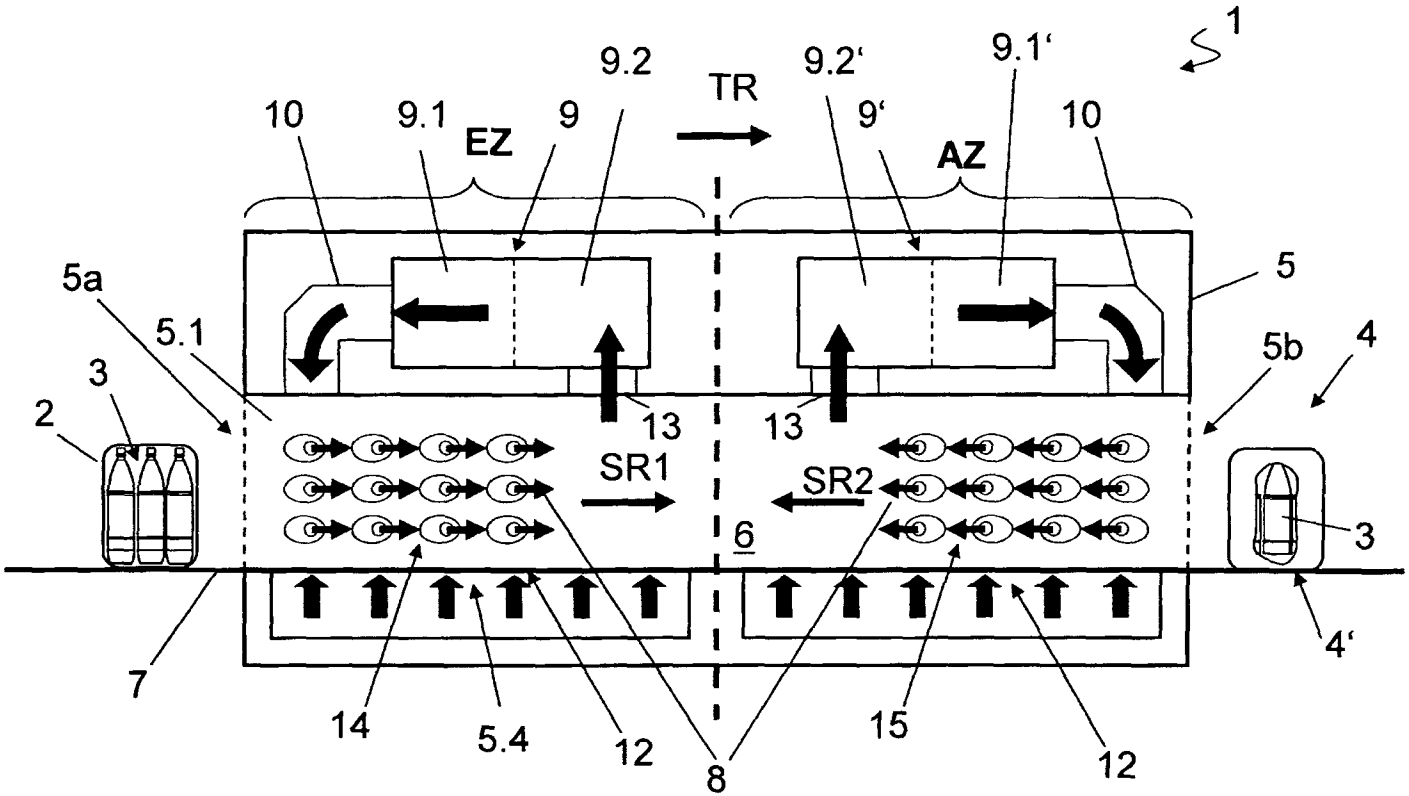
FIG. 1 shows a simplified schematic longitudinal section through a shrink-tunnel system according to the invention.
Figure 3:
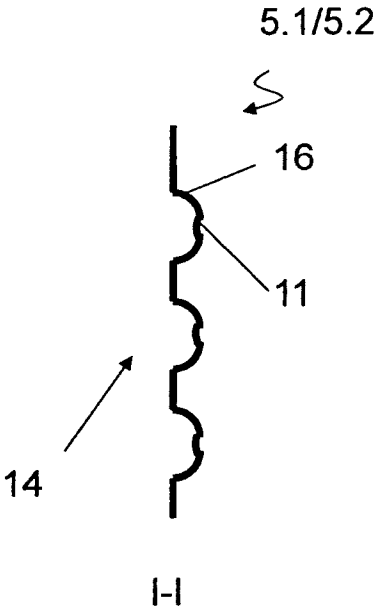
FIG. 3 shows a section along the axis I-I through the lateral wall shown in FIG. 2.

FIGS. 1 and 3 show a shrink-tunnel system 1 for shrinking a shrink film 2 onto a package formation 3.

As used herein, a package formation 3 includes sets of packaged goods that are to be packaged with shrink film. Examples include sets of containers, bottles, cans or similar individual packages that, upon being bound together by shrink film 2, form a packaging unit 4 or a cluster pack. In some embodiments, the shrink film 2 is a printed film.

The shrink-tunnel system 1 includes a tunnel housing 5. In some embodiments, the tunnel housing 5 has multiple parts. In either case, the tunnel housing 5 defines a tunnel interior 6 that is separated from the exterior by at least first and second lateral tunnel-walls 5.1, 5.2 opposite each other, and a top and bottom tunnel-wall 5.3, 5.4. In some embodiments, the tunnel-walls 5.1-5.4 are held in the tunnel housing 5. In other embodiments, the tunnel-walls 5.1-5.4 at least in part form the tunnel housing 5.

Referring to FIG. 1, a conveyor 7 carries a package formation 3 that has been loosely wrapped with shrink film 2. The conveyor 7 carries this package formation 3 through a tunnel inlet 5*a* and into an inlet zone EZ within the tunnel interior 6. It continues carrying the package formation into an adjoining outlet zone EZ and on out through a tunnel outlet 5*b*. In some embodiments, the conveyor 7 is a conveyor belt.

Within the tunnel interior 6, the package formation 3 encounters a flow 8 of hot air. This hot-air flow 8 shrinks the shrink film 2 tightly so that the resulting packaging unit 4 approximates the external shape of the package formation 3.

Hot air used for the hot-air flow 8 comes from a heating/blower arrangement 9, 9', which is preferably located above the tunnel interior 6. A pipe distribution system 10 feeds this hot air into the tunnel interior 6 through first openings 11 and second openings 12. The first openings 11 are in the lateral tunnel-walls 5.1, 5.2. The second openings 12 are in the bottom tunnel wall 5.4.

The heating/blower arrangement 9, 9' draws partially-cooled hot air from the tunnel interior 6 through an extractor opening 13 in the top tunnel wall 5.3, as shown in FIG. 1. The heating/blower arrangement 9, 9' then heats this partially-cooled hot air all over again and recirculates it. Preferably, the hot air is heated to a temperature in the range of approximately 320° F. to 450° F. for shrinking the shrink film 2.

The shrink-tunnel system 1 includes first and second air-conductors 14, 15 for providing a targeted hot-air flow 8 onto the shrink film 2. The first air-conductor 14 introduces hot-air flow 8 along a first flow-direction SR1 that is oriented along the conveying direction TR. The second air-conductor 15 introduces a hot-air flow 8 along a second flow-direction SR2 that is oriented opposite the conveying direction TR. In the transitional area between the inlet zone EZ and the outlet zone AZ, the direction of hot-air flow 8 changes.

The first and second air-conductors 14, 15 are designed to generate a constantly-rising hot-air flow 8 with a specified direction along the inlet and outlet zone EZ, AZ. To achieve this, the first and/or second air-conductors 14, 15 are preferably arranged along the lateral tunnel-wall 5.1, 5.2. In alternative embodiments, they are partially formed by the lateral tunnel-wall 5.1, 5.2 itself. In yet other embodiments, they are integrated into the lateral tunnel-wall 5.1, 5.2. The air conductors 14, 15 are preferably also configured to generate a hot-air flow 8 that is evenly distributed along a vertical direction, at least over the height of the packaging units 4 if not over the height of the tunnel interior 6.

Within the tunnel interior 6 is a lower air-layer zone under the conveyor 7. The pipe distribution system 10 directs some hot air into this zone. This air exits the lower air-layer zone through the second openings 12 in a direction perpendicular to the conveying direction TR and directed toward the top tunnel wall 5.3.

It is particularly advantageous to apply the oriented hot-air flow 8 to the ends of the shrink film 2 that project laterally over the package formations. These ends will be referred to herein as the "free ends."

Preferably, the hot-air flow 8 is applied in alternation. In this way, the free ends are turned over such that they come to rest on the open faces 3' of the package formation 3, namely those that are not wrapped with the shrink film 2.

Because the flow-directions SR1, SR2 are oriented in opposite directions, the free ends of the shrink film 2 that are oriented in the conveying direction TR and the free ends of the shrink film 2 that are on the opposite end, which are thus oriented against the conveying direction TR, are turned over on the faces 3' of the package formation 3 in an optimum manner. As a result, they can be shrunk on with reduced wrinkle formation. In this context, a window-like opening 4' arises, which provides a view of the section of the package formation not enclosed by the shrink film 2.

As shown in FIG. 1, a package formation 3 enclosed by the shrink film 2 is fed to the shrink-tunnel system 1 in such a way that a first open face 3' of the package formation 3 faces the first lateral tunnel-walls 5.1 and a second open face 3' faces the second lateral tunnel wall 5.2. This direction causes hot-air flow 8 to have a velocity vector that is generally tangential to the open faces 3' of the package formation 3.

In some embodiments, the lateral tunnel-walls 5.1, 5.2 are metal panels that have a multiplicity of first openings 11 to supply hot-air flow 8 into the tunnel interior 6. These openings 11 thus form the first and second air-conductors 14, 15.

Within the inlet zone EZ, the first openings 11 are shaped to direct hot-air flow 8 emerging therefrom along either a first flow-direction SR1. These collectively define the first air-conductor 14. Within the outlet zone AZ, the first openings 11 are shaped to direct hot-air flow 8 emerging therefrom along the second flow-direction SR2. These collectively define the second air-conductor 15.

Figure 2:
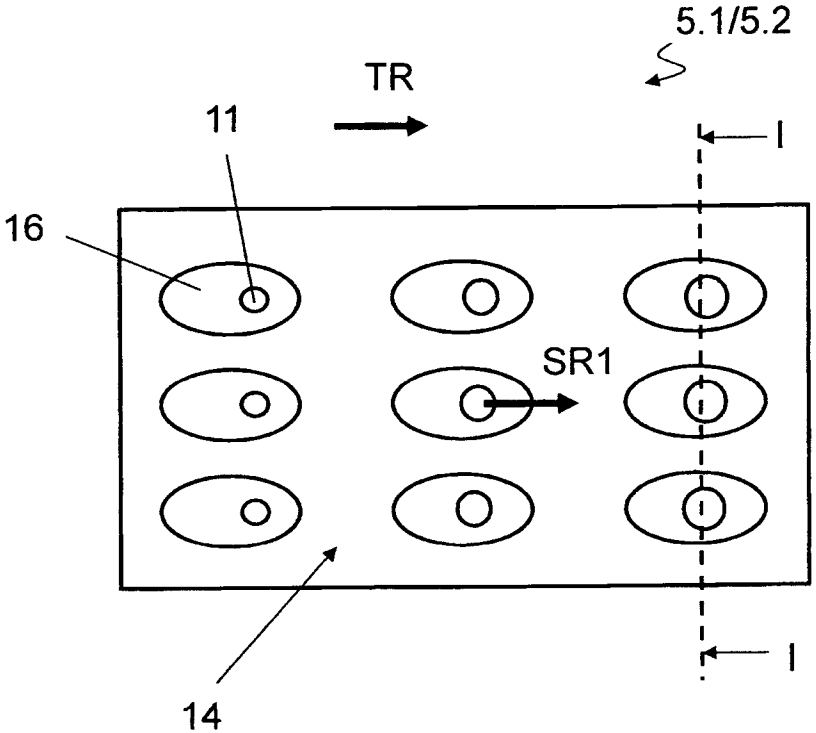
FIG. 2 shows a view from above a lateral wall of the tunnel housing shown in FIG. 1.

Referring to FIGS. 2 and 3, in a preferred embodiment, a first opening 11 is made through the lateral tunnel-walls 5.1, 5.2. This can be carried out by metal punching or by a laser. Next, an embossing tool embosses an area 16 around the first opening 11. The resulting embossed area 16 has an outwardly bowed contour that protrudes into the tunnel interior 6. The position of the opening 11 within the area 16 determines the direction in which hot-air flow 8 exits the opening 11.

The spacings and the diameters of the first openings 11 are selected to control the magnitude of the hot-air flow 8 needed for the shrink process. The first openings 11 are preferably arranged in a matrix of rows and columns on the lateral tunnel-walls 5.1, 5.2.

The bowed contour of the areas 16 can be circular or oval. The location of the opening 11 within the bowed area can also vary. For example, the first openings 11 can be made to lie near an edge of the bowed areas 16. This will tend to increase the tangential component of the velocity vector at the cost of the normal component thereof.

FIG. 2 shows a view facing a lateral tunnel-wall 5.1, 5.2 in which openings 11 have been embossed to direct flow along the first direction SR1. FIG. 3 shows a section along the line I-I through the lateral tunnel-wall 5.1, 5.2 in FIG. 2. The first openings 11 together with the bowed areas 16 thus form a nozzle-like structure.

Within the inlet zone EZ, the first openings 11 are shaped to direct gas flow 8 in a first flow-direction SR1. Meanwhile, within the outlet zone AZ, the first openings 11 are shaped to direct gas flow 8 in in a second flow-direction SR2 against the conveying direction TR.

In some embodiments, the diameters of the nozzle-like first openings 11 are not all the same. In particular, the diameters increase in the conveying direction TR so that the volume of hot-air flow 8 introduced into the tunnel interior 6 by the first openings 11 increases in the conveying direction TR. Advantageously, in this way, the hot-air flow 8 is applied to the shrink films 2 alternately in and against the conveying direction TR, and thus the front or reverse of the shrink film 2 is raised from the package formation 3. This improves the result of the shrinking process.

Figure 4:
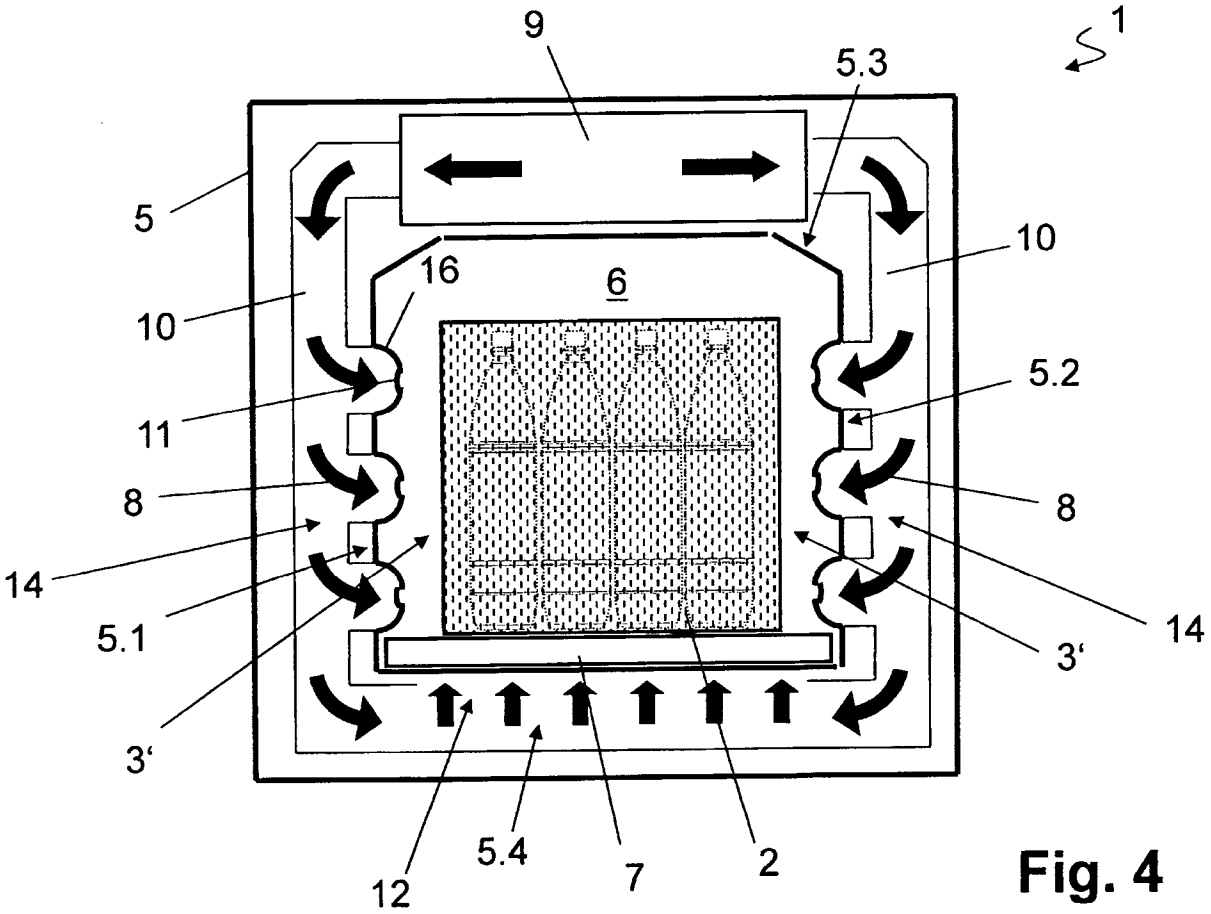
FIG. 4 shows a simplified schematic cross-section through the shrink-tunnel system of FIG. 1.

FIG. 4 shows a cross-section through the shrink-tunnel system 1. In general, a package formation 3 will have four free-ends. A first and second free-end will face the first lateral-wall 5.1 and a third and fourth free-end will face the second lateral-wall 5.2. The package formation 3 is always oriented such that the first and third free-ends are closest to the tunnel inlet 6*a* and the second and fourth free-ends are closest to the tunnel outlet 6*b*.

While the package formation 3 is in the inlet zone EZ, the flow 8 is in the conveying direction TR. This flow 8 will tend to fold the first and third free-ends towards the package formation 3 and to lift the second and fourth free-ends away from the package formation 3.

In the transitional area between the inlet zone EZ and the outlet zone AZ, the direction of the flow 8 changes. In the outlet zone AZ, a hot-air flow 8 oriented against the conveying direction TR is now applied to the package formation 3. The second and fourth free-ends of the shrinking film 2 are thus blown against the conveying direction TR and folded onto the package formation 3.

In some embodiments, such as that shown in FIG. 1, a first heating/blower arrangement 9 serves the inlet zone EZ and a second heating/blower arrangement 9' serves the outlet zone AZ.

The first heating/blower arrangement 9 has a first blower unit 9.1 and a first heating unit 9.2. At the end of the inlet zone EZ, the first blower unit 9.1 draws air out of the tunnel interior 6 through a first extractor opening 13 and feeds it to the first heating unit 9.1 for heating. The pipe distribution system 10 then routes the heated air from the first heating unit 9.1 to the first openings 11 provided in the inlet zone EZ so that the hot air can be fed back into the tunnel interior 6.

Similarly, the second heating/blower arrangement 9' has a second blower unit 9.1' and a second heating unit 9.2'. At the end of the outlet zone AZ, the second blower unit 9.1' draws air out of the tunnel interior 6 through a second extractor opening 13, and feed it to the second heating unit 9.2' for heating. The pipe distribution system 10 then routes the heated air from the second heating unit 9.2' to the first openings 11 arranged in the outlet zone AZ so that the hot air can be fed back into the tunnel interior 6.

In some embodiments, the shrink-tunnel system 1 includes a temperature sensor for sensing the temperature of the hot air or of the gas flow 8 in the tunnel interior 6. This measured temperature can then be used to adjust heating/blower arrangements 9, 9' accordingly.

Figure 6:
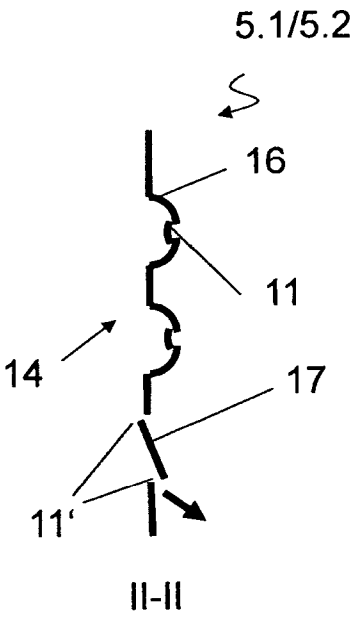
FIG. 6 shows a section along the axis II-II through the lateral wall shown in FIG. 5.
Figure 5:
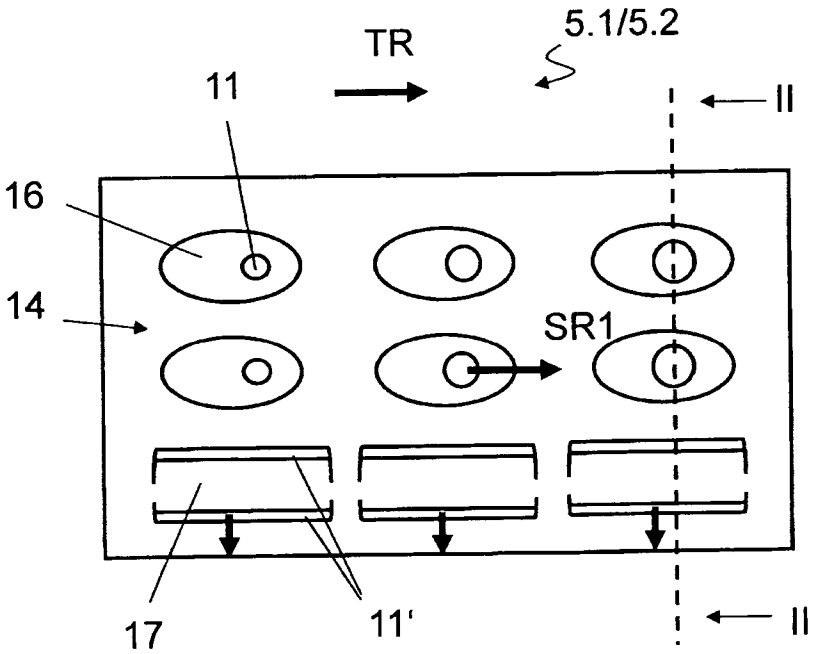
FIG. 5 shows a view from above an alternative embodiment of the lateral wall shown in FIG. 2.

In a further embodiment, shown in FIGS. 5 and 6, the first openings 11 that are closest to the conveyor 7 are slot-shaped openings 11'. Each slot-shaped opening 11' on the first lateral tunnel-wall 5.1 has a corresponding slot-shaped opening on the second lateral tunnel-wall 5.2 that lies on the opposite side of the conveyor 7. A slot-shaped openings 11' is made by punching a rectangular hole in a lateral tunnel-wall 5.1, 5.2 while leaving behind a guide panel section 17 that can be bent to direct flow in a desired direction, as shown in FIG. 6.

Slot-shaped openings 11' along conveyor 7 permit targeted application of the free ends of the shrink film 2 projecting on the front face. In particular, the section of the free ends of the shrink film 2 oriented in the direction of the conveyor 6 is raised and routed in the direction of the front face 3' of the package formation 3.

The invention has been described above using various embodiments as examples. However, other embodiments are possible without departing from the scope of the invention as defined by the attached claims.

Having described the invention, and a preferred embodiment thereof, what is claimed as new, and secured by letters patent is:

1. An apparatus for shrinking a shrink film onto a package formation, said apparatus comprising a shrink tunnel-system, wherein said shrink tunnel-system comprises a tunnel housing, a conveyor, and gas conductors, wherein said tunnel housing encloses a tunnel interior, wherein said conveyor moves a package formation wrapped with shrink film through said tunnel interior along a conveying direction, wherein said gas conductors direct hot-gas into said tunnel interior along a first flow-direction and a second flow-direction, wherein said first flow-direction is parallel to said conveying direction, and wherein said second flow-direction is opposite said first flow-direction.

2. The apparatus of claim 1, wherein said gas conductors direct hot gas into said tunnel interior in a first direction, wherein some of said gas conductors direct hot gas into said tunnel interior in said first flow-direction, and wherein others of said gas conductors direct hot gas into said tunnel interior in said second flow-direction.

3. The apparatus of claim 1, wherein, in operation, an average flow of hot gas within said tunnel housing is equal to zero, wherein said average flow is a volume integral of a flow field within said tunnel interior.

4. The apparatus of claim 1, wherein said tunnel interior comprises an inlet zone and an outlet zone, wherein said inlet zone adjoins said outlet zone, wherein said gas conductors comprise a first set of gas conductors and a second set of gas conductors, wherein gas conductors in said first set of gas conductors are disposed in said inlet zone, wherein gas conductors in said second set of gas conductors are disposed in said outlet zone, wherein said gas conductors in said first set of gas conductors introduce said hot-gas flow in said first flow-direction, and wherein gas conductors in said second set of gas conductors introduce said hot-gas flow in said second flow-direction.

5. The apparatus of claim 1, wherein said gas conductors are configured to cause hot-gas flow to rise constantly along said conveying direction.

6. The apparatus of claim 1, wherein further comprising a first lateral tunnel-wall and a second lateral tunnel-wall, wherein said gas conductors are arranged along said lateral tunnel-walls, and wherein said lateral tunnel-walls at least in part define said tunnel interior.

7. The apparatus of claim 1, wherein said gas conductors are formed at least in part by lateral tunnel-walls that define at least in part said tunnel interior.

8. The apparatus of claim 1, wherein said gas conductors are integrated into lateral tunnel-walls that at least in part define said tunnel interior.

9. The apparatus of claim 1, wherein said gas conductors are configured to cause said hot-gas flow to be distributed evenly along a height of said tunnel interior.

10. The apparatus of claim 1, further comprising a lateral tunnel-wall that at least in part defines said tunnel interior, wherein said gas conductors comprise a set of openings in said lateral tunnel-wall, wherein said set of openings comprises a first opening and a second opening.

11. The apparatus of claim 10, wherein said first opening directs hot gas along said first flow-direction, and wherein said second opening directs hot gas along said second flow-direction.

12. The apparatus of claim 10, further comprising a set of areas in said lateral tunnel-wall, wherein said set of areas comprises a first area, wherein said first area surrounds said first opening, and wherein each area in said set of areas is bowed so as to protrude into said tunnel interior.

13. The apparatus of claim 12, wherein said first area comprises a structural feature indicative of said first area having been embossed.

14. The apparatus of claim 10, further comprising a set of nozzles in said lateral tunnel-wall, and a set of areas in said lateral tunnel-wall, wherein said set of areas comprises a first area, wherein said set of nozzles comprises a first nozzle, wherein said first area surrounds said first opening, and wherein said first nozzle comprises said first area and said first opening.

15. The apparatus of claim 10, wherein said first opening comprises a structural feature indicative of a manner in which said first opening was made, and wherein said structural feature indicates said first opening having been made by a laser.

16. The apparatus of claim 10, wherein said tunnel housing defines an axis, wherein said openings in said set of openings have diameters, wherein each opening has a position along said axis, wherein diameters of said openings vary as a function of a position of said opening on said axis, and wherein said diameters increase monotonically with position.

17. The apparatus of claim 10, wherein said set of openings comprises slots, and wherein said slots are adjacent to said conveyor.

18. The apparatus of claim 1, further comprising a lateral tunnel-wall that at least in part defines said tunnel interior, wherein said lateral tunnel-wall comprises a metal panel, wherein said gas conductors comprise a set of openings formed in said metal panel, and wherein said set of openings comprises a first opening and a second opening.

19. The apparatus of claim 18, wherein said first opening comprises a structural feature indicative of a manner in which said first opening was made, and wherein said structural feature indicates said first opening having been made by a metal punch.

20. A method for shrinking a shrink film onto a package formation, said method comprising moving a package formation that has been loosely wrapped with shrink film through a tunnel interior along a conveying direction, and, while said package formation is in said tunnel interior, exposing said package formation to hot-gas flow that is directed along a first direction and to hot-gas flow that is directed along a second direction that is opposite to said first direction, wherein said first direction is parallel to said conveying direction.

21. The method of claim 20, wherein exposing said package formation to hot-gas flow that is directed along a first direction and to hot-gas flow that is directed along a second direction that is opposite to said first direction comprises passing said package formation through an inlet zone, at said inlet zone, exposing said package formation to said hot-gas flow that is directed along said first direction, passing said package formation through an outlet zone, and, at said outlet zone, exposing said package formation to said hot-gas flow that is directed along said second direction.

22. The method of claim 20, wherein exposing said package formation to hot-gas flow that is directed along a first direction comprises causing hot gas to enter said tunnel interior through gas conductors provided on lateral walls that at least in part define said tunnel interior.

* * * * *